US008115131B2

(12) United States Patent
Domzalski

(10) Patent No.: US 8,115,131 B2
(45) Date of Patent: Feb. 14, 2012

(54) ELECTRICAL PUSHBUTTON SNAP SWITCH

(75) Inventor: Frank Mark Domzalski, Wellesley, MA (US)

(73) Assignee: CoActive Technologies, LLC, Newton, MA (US)

( * ) Notice: Subject to any disclaimer, the term of this patent is extended or adjusted under 35 U.S.C. 154(b) by 366 days.

(21) Appl. No.: 12/535,401

(22) Filed: Aug. 4, 2009

(65) Prior Publication Data

US 2010/0025205 A1 Feb. 4, 2010

(30) Foreign Application Priority Data

Aug. 4, 2008 (EP) ..... 08161739

(51) Int. Cl.
*H01H 5/08* (2006.01)

(52) U.S. Cl. ..... 200/467

(58) Field of Classification Search ..... 200/459, 200/462, 467
See application file for complete search history.

(56) References Cited

U.S. PATENT DOCUMENTS 4,636,597 A 1/1987 Menche
6,255,611 B1 7/2001 Chou
7,205,496 B2 4/2007 Schober et al.

*Primary Examiner* — Vanessa Girardi
(74) *Attorney, Agent, or Firm* — Pepper Hamilton LLP

(57) ABSTRACT

A switch for selectively establishing a first conductive way between a first conductive fixed contact and a second conductive fixed contact or a second conductive way between the first conductive fixed contact and a third conductive fixed contact. The switch includes a housing and a pushbutton extending out of the housing and comprising a driving portion formed by an extension extending into the housing, the pushbutton being arranged, when an external force is applied to the pushbutton, to be moved relative to the housing between a first pushbutton active position in which the first conductive way is established and a second pushbutton active position in which the second conductive way is established.

14 Claims, 10 Drawing Sheets

ELECTRICAL PUSHBUTTON SNAP SWITCH

CROSS REFERENCE TO RELATED APPLICATIONS

This application claims the priority benefit of European Patent Application No. 0816139.1 filed Aug. 4, 2008.

BACKGROUND

The present invention relates to an electrical switch, also known as a snap switch. Such an electrical snap switch is designed for selectively establishing either a first conductive way between a first conductive fixed contact and a second conductive fixed contact or a second conductive way between the first conductive fixed contact and a third conductive fixed contact. Typical electrical snap switches may include a housing and a pushbutton extending out of the housing and comprising a driving portion formed by an extension extending into the housing, the pushbutton being arranged, when an external force is applied to the pushbutton, to be moved relative to the housing between a first pushbutton active position in which the first conductive way is established and a second pushbutton active position in which the second conductive way is established. The electrical snap switch may further include a conductive unit which is fixed with respect to the housing and which includes first, second, and third conductive fixed contacts. The electrical snap switch may include a switching unit comprising a conductive swaying element, a first end of the conductive swaying element being pivotally engaged with the first conductive element, and the second end of the conductive swaying element being arranged to selectively electrically connect the first conductive fixed contact to either the second or the third conductive fixed contact, and a traction spring having a first end operatively connected to the housing and a second end secured to the swaying element such that when the pushbutton is in the first pushbutton position, the spring is in a first spring position and the spring causes the swaying element to electrically connect the first and second conductive fixed contacts, and when the pushbutton is moved to the second pushbutton position, the spring is moved to a second spring position and the spring causes the swaying element to also move to electrically connect the first and third conductive fixed contacts, An example of such a switch is disclosed in U.S. Pat. No. 7,205,496, the contents of which are hereby incorporated by reference, in which the spring is a helicoidally wounded traction spring and in which the pushbutton driving portion acts on the middle section of the spring. Due to this arrangement, an abrupt changeover of the switching unit occurs but it is not possible to obtain a quick changeover and, furthermore, the elastic behaviour of the spring is affected by its cooperation with the driving portion and the changeover point, or instant, varies and the switch is therefore not reliable. The same drawbacks are also inherent to the design disclosed in U.S. Pat. No. 4,636,597.

An attempt to improve the working of such a snap switch is illustrated in U.S. Pat. No. 6,255,611 in which the switching unit is bistable between first and second positions of the swaying element, in which the switch comprises a return spring which is disposed between the housing and the pushbutton, in which, when an external force applied to the pushbutton is removed, the pushbutton is returned back to its original first active position by the return spring, and in which the traction spring has a first end connected to the driving portion of the pushbutton and a second end secured to the swaying element, so that when the pushbutton is in the first pushbutton position, the first end of the traction spring is in a first spring position, and when the pushbutton is moved to the second pushbutton position, the first end of the spring is moved to a second spring position.

According to such an arrangement, when an external force is applied to the pushbutton, the jointed end of the driving portion of the pushbutton and the elastic spring is forced to move downwards until it passes a critical line, at which point the swaying element is coupled with another conductive fixed contact to supply power or electrical signals.

However, the changeover speed remains insufficient and no solution is provided for a "double" or "twin" design for selectively establishing simultaneously two first conductive ways, each one between a first conductive fixed contact and a second conductive fixed contact. Similarly, there is no design that simultaneously provides two second conductive ways, each one between the first conductive fixed contact and a third conductive fixed contact.

SUMMARY

The invention described in this document is not limited to the particular systems, methodologies or protocols described, as these may vary. The terminology used herein is for the purpose of describing particular embodiments only, and is not intended to limit the scope of the present disclosure.

It should be noted that as used herein and in the appended claims, the singular forms "a," "an," and "the" include plural references unless the context clearly dictates otherwise. Unless defined otherwise, all technical terms used herein have the same meanings as commonly understood by one of ordinary skill in the art. As used herein, the term "comprising" means including, but not limited to."

In one general respect, the embodiments disclose a switch for selectively establishing a first conductive way between a first conductive fixed contact and a second conductive fixed contact or a second conductive way between the first conductive fixed contact and a third conductive fixed contact. The switch includes a housing and a pushbutton extending out of the housing and comprising a driving portion formed by an extension extending into the housing, the pushbutton being arranged, when an external force is applied to the pushbutton, to be moved relative to the housing between a first pushbutton active position in which the first conductive way is established and a second pushbutton active position in which the second conductive way is established. The switch also includes a conductive unit which is fixed with respect to the housing and which includes the first, second, and third conductive fixed contacts; and a switching unit. The switching unit includes a conductive swaying element, wherein a first end of the conductive swaying element is pivotally engaged with the first conductive fixed contact, and a second end of the conductive swaying element is arranged to selectively electrically connect the first conductive fixed contact to either the second or the third conductive fixed contact, and a traction spring having a first end operatively connected to a driving portion of the pushbutton and a second end secured to the swaying element. The switch is configured such that when the pushbutton is in the first pushbutton active position, the first end of the traction spring is in a first spring position and the traction spring causes the swaying element to electrically connect the first and second conductive fixed contacts, and when the pushbutton is moved to the second active pushbutton position, the first end of the traction spring is moved to a second spring position and the traction spring causes the swaying element to move to electrically connect the first and third conductive fixed contacts. The switch is further configured such that the switching unit is bistable between the first and second positions of the swaying element, the switch comprises a return spring which is disposed between the housing and the pushbutton, and when an external force applied to the pushbutton is removed, the pushbutton is returned back to its original first active position by the return spring.

In another general respect, the embodiments disclose a switch for selectively establishing simultaneously two first conductive ways, each one between a first conductive fixed contact and a second conductive fixed contact or simultaneously two second conductive ways, each one between the first conductive fixed contact and a third conductive fixed contact. The switch includes a housing and a pushbutton extending out of the housing and comprising a driving portion formed by an extension extending into the housing, the pushbutton being arranged, when an external force is applied to the pushbutton, to be moved relative to the housing between a first pushbutton active position in which the first conductive ways are established and a second pushbutton active position in which the second conductive ways are established. The switch also includes a conductive unit which is fixed with respect to the housing and which includes the first, second, and third conductive fixed contacts and a switching unit. The switching unit includes a pair of conductive swaying elements, a first end of each conductive swaying element being pivotally engaged with a first associated conductive fixed contact, and the second end of each conductive swaying element being positioned to selectively electrically connect the first associated conductive fixed contact to either a second associated conductive fixed contact or a third associated conductive fixed contact, and a traction spring having a first end operatively connected to the driving portion of the pushbutton and a second end secured to the swaying elements. The switch is configured such that when the pushbutton is in the first pushbutton position, the first end of the traction spring is in a first spring position and the traction spring causes the swaying elements to electrically connect the first and second associated conductive fixed contacts, and when the pushbutton is moved to the second pushbutton position, the first end of the traction spring is moved to a second spring position and the traction spring causes the swaying elements to also move to electrically connect the first and third associated conductive fixed contacts. The switch is further configured such that the switching unit is bistable between the first and second positions of the swaying element, the switch comprises a return spring which is disposed between the housing and the pushbutton, and when an external force applied to the pushbutton is removed, the pushbutton is returned back to its original first active position by the return spring.

BRIEF DESCRIPTION OF THE FIGURES

Other characteristics and advantages of the invention will become apparent from reading the following detailed description, for an understanding of which reference should be made to the appended drawings in which.

DETAILED DESCRIPTION OF THE FIGURES

In the description that follows, identical, similar or analogous components are designated by the same reference numbers.

Figure 4:
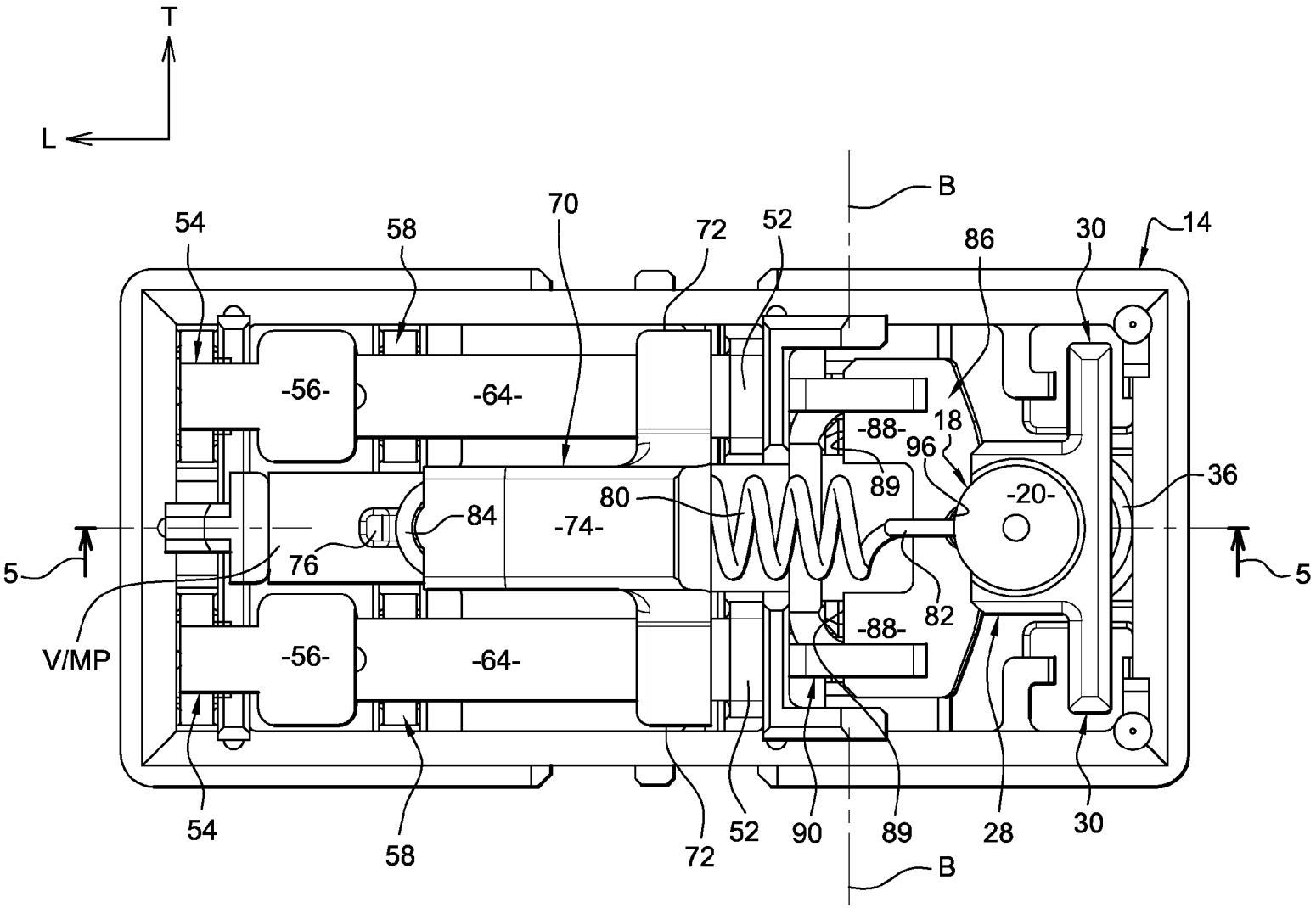
FIG. 4 is a top view the various components illustrated in of FIG. 3.

As a non-limiting example, to assist in understanding the description and the claims, the terms vertical, horizontal, bottom, top, up, down, transversal, longitudinal, and so on will be adopted with reference to the L, V, T trihedron indicated in the figures, and without any reference to the gravity. In the illustrated embodiment, the design of an electrical switch may be symmetrical with respect to the vertical median plane VMP corresponding to exemplary line 5-5 of FIG. 4.

Figure 1:
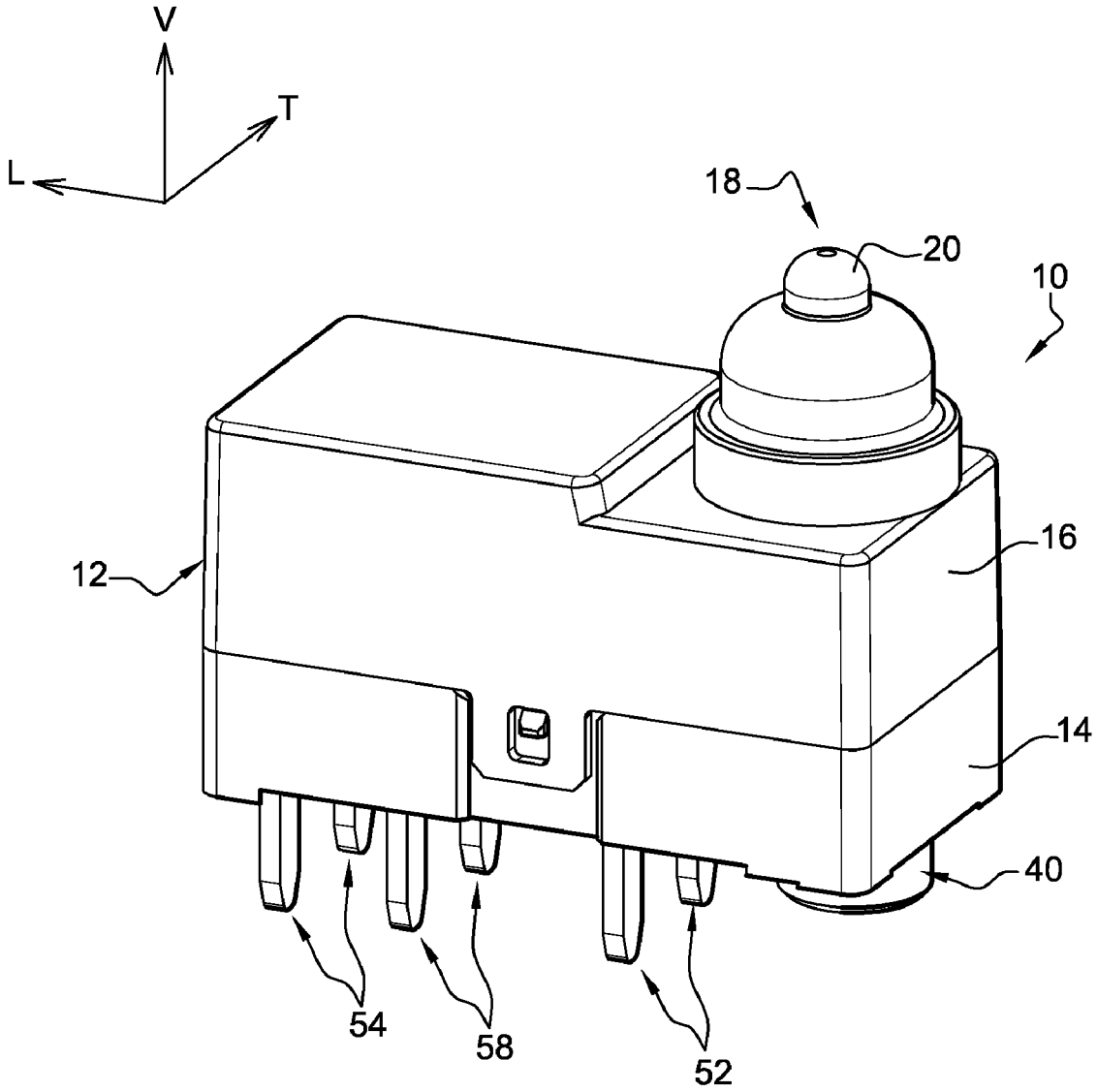
FIG. 1 is a top perspective view which illustrates various embodiments of an embodiment of a bistable snap switch according to principles of the present invention.

FIG. 1 shows a snap switch 10. The snap switch 10 may include a housing 12, of rectangular parallelepipedic shape. The housing 12 may be made of a housing upper part or half 16 and a housing lower part or half 14, each of which may be made of moulded plastics and ultrasonic welded to each other after mounting and assembly.

Figure 2:
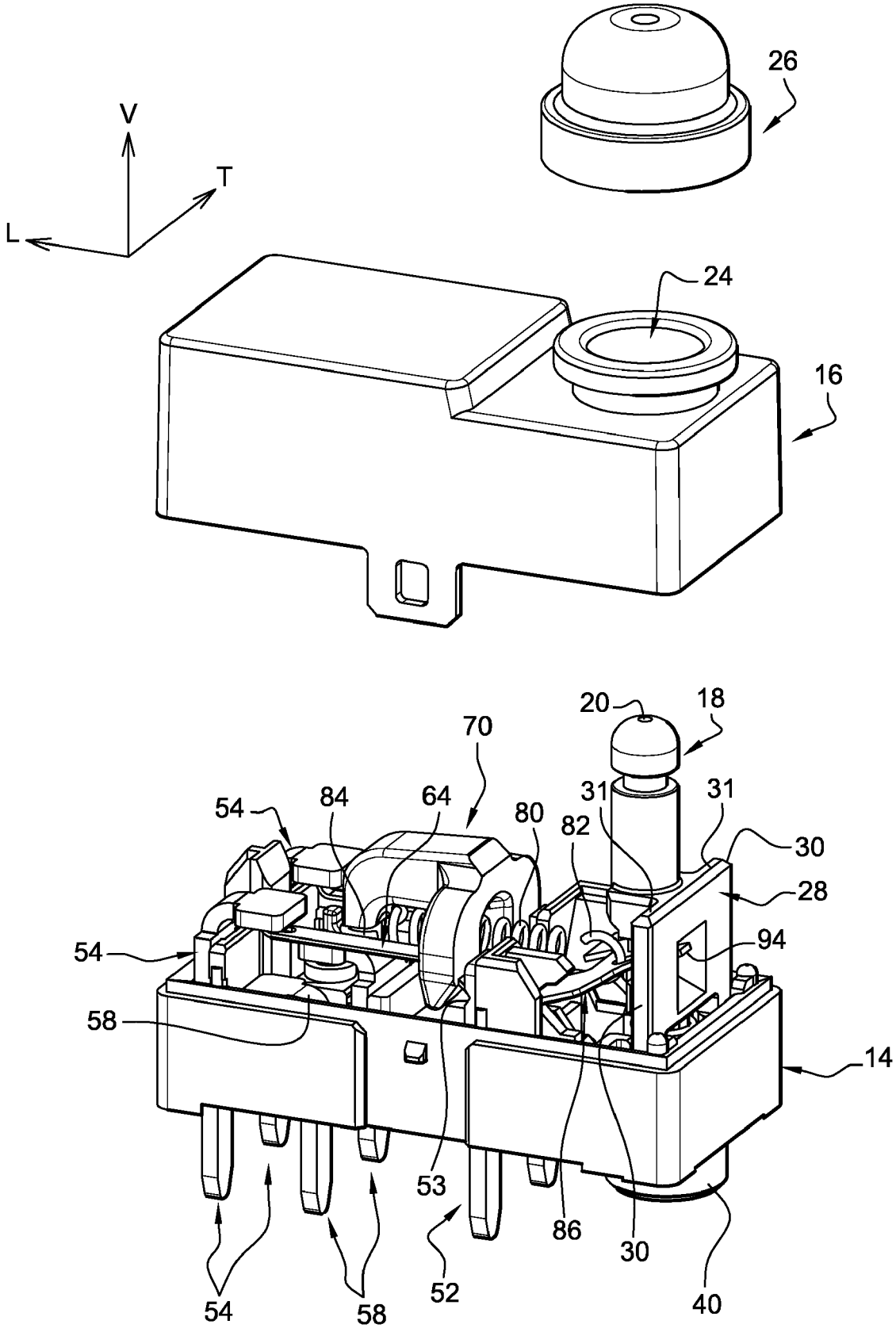
FIG. 2 is a perspective view similar to FIG. 1 showing various components in an exploded view.
Figure 8:
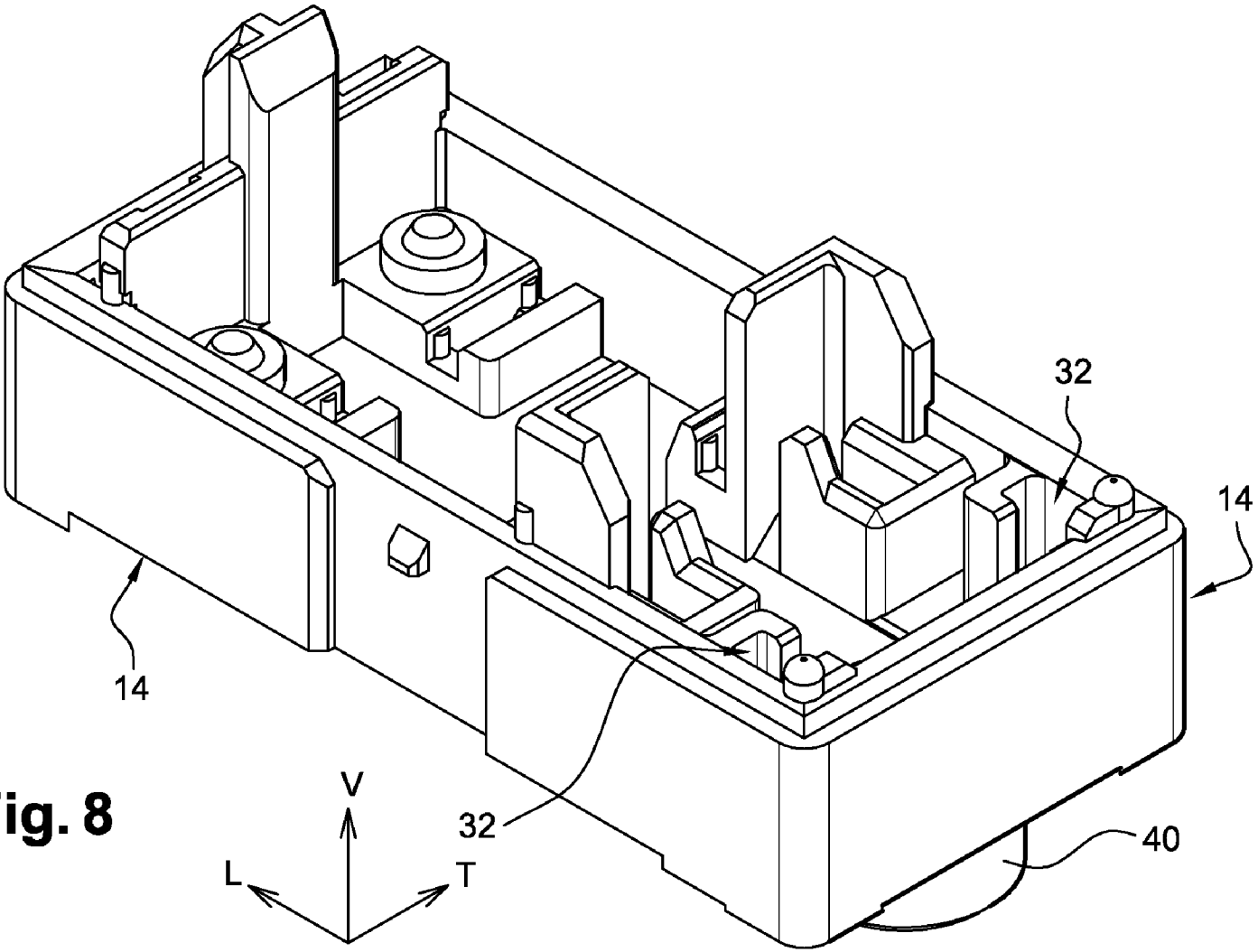
FIG. 8 is a top perspective view of a lower half of the snap switch housing.
Figure 9:
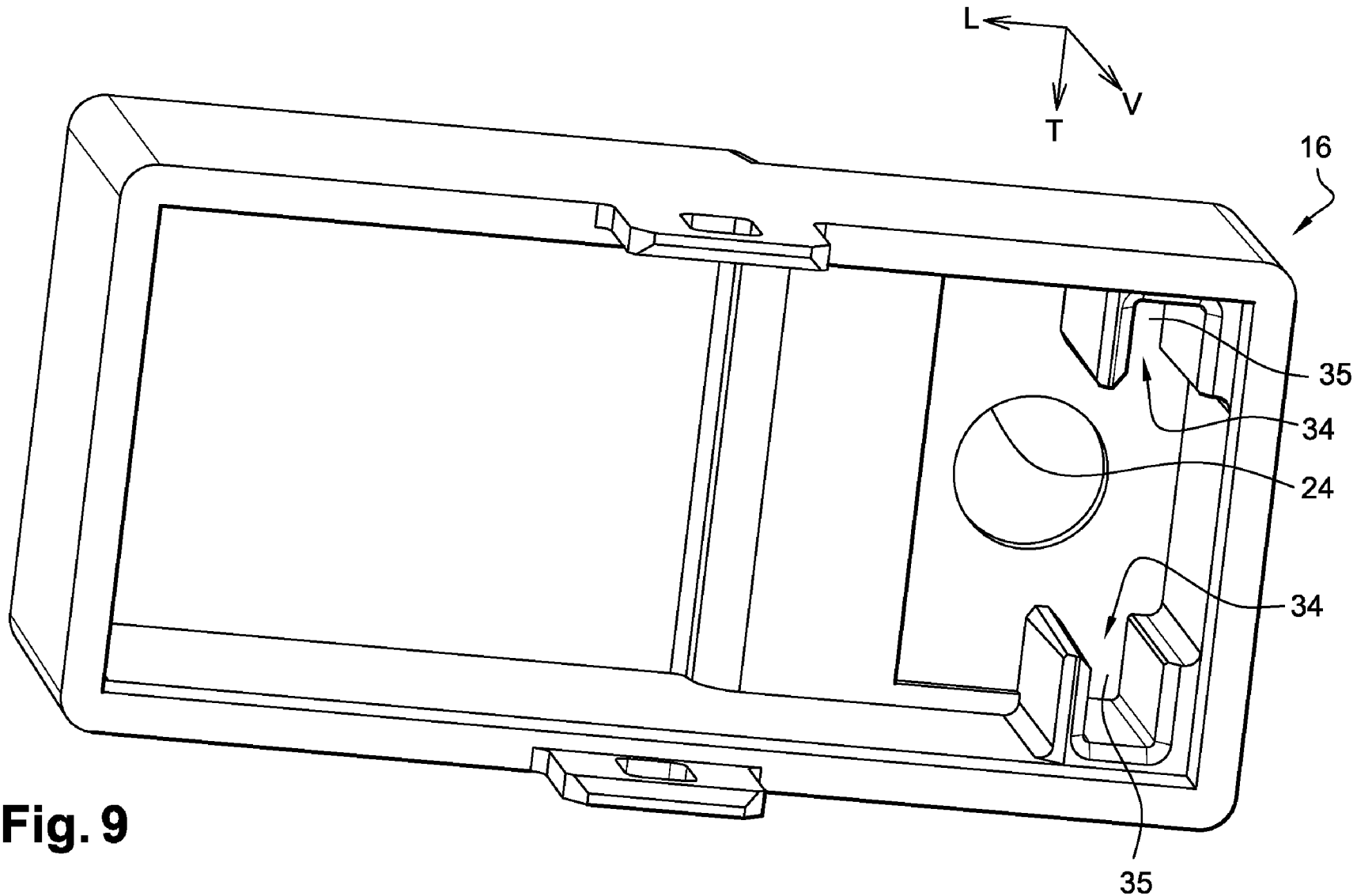
FIG. 9 is a bottom perspective view of a upper half of the snap switch housing.

As shown in FIG. 2, the switch 10 may also comprise a vertically extending and displaceable pushbutton 18 having a free upper end 20 for receiving an actuation force. A main vertical upper stem 22 of the pushbutton 18 may extend through a hole 24 of the housing upper part 14 in combination with a sealing boot 26. The pushbutton 18 may be a plastic moulded part comprising a lower driving portion 28 which is an extension of the main vertical stem 22 and which is arranged and extends inside the housing 12. The lower driving portion 28 may comprises a pair of vertically and transversely extending lateral guiding wings 30 which are received in mating and complementary pairs of vertical grooves 32 and 34 which may be arranged in the two halves 14 and 16 of the housing 10 (as shown in FIGS. 8 and 9).

Figure 5A:
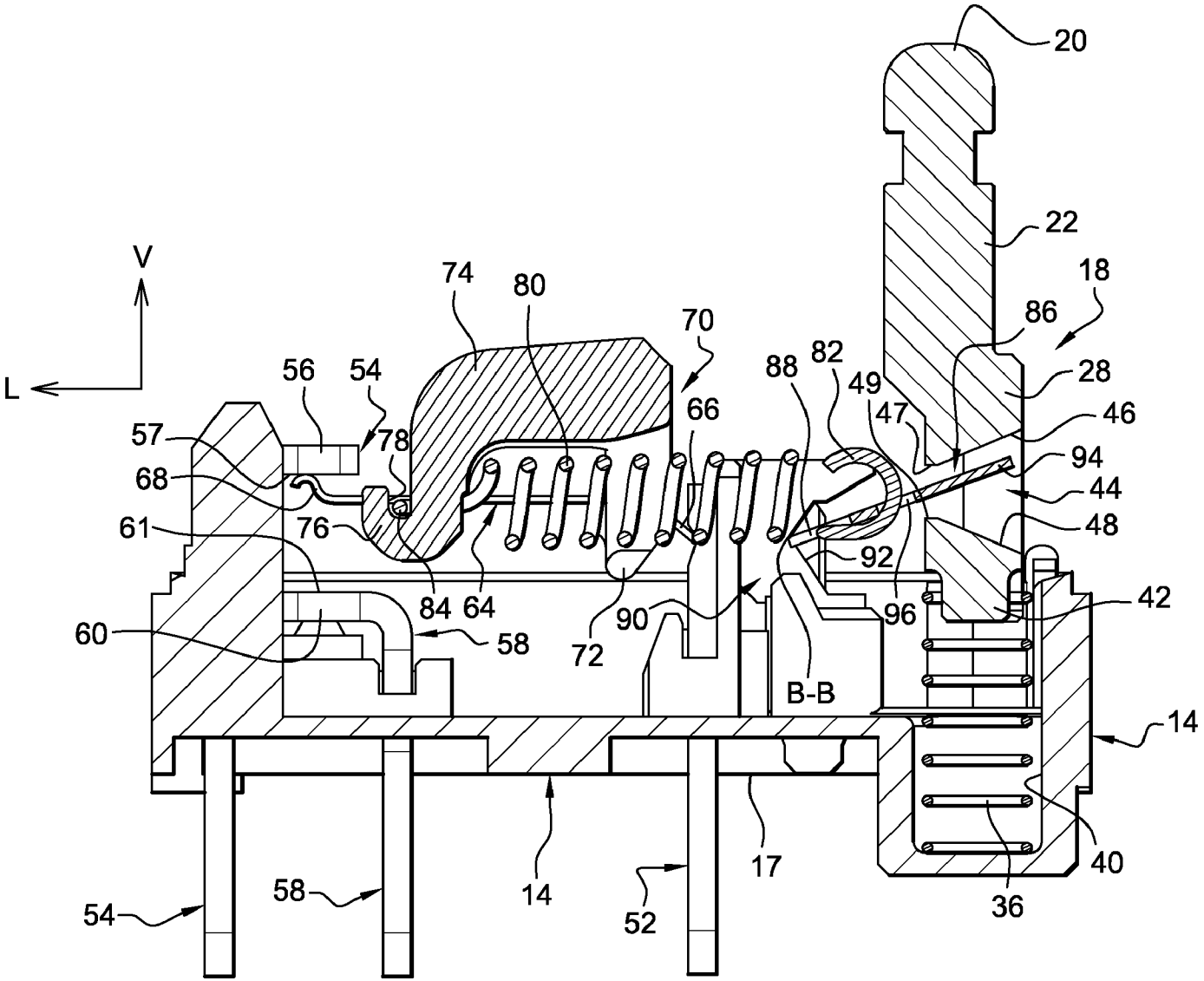
FIG. 5A is a cross-sectional view taken along line 5-5 of FIG. 4 showing various components in their first position.
Figure 5B:
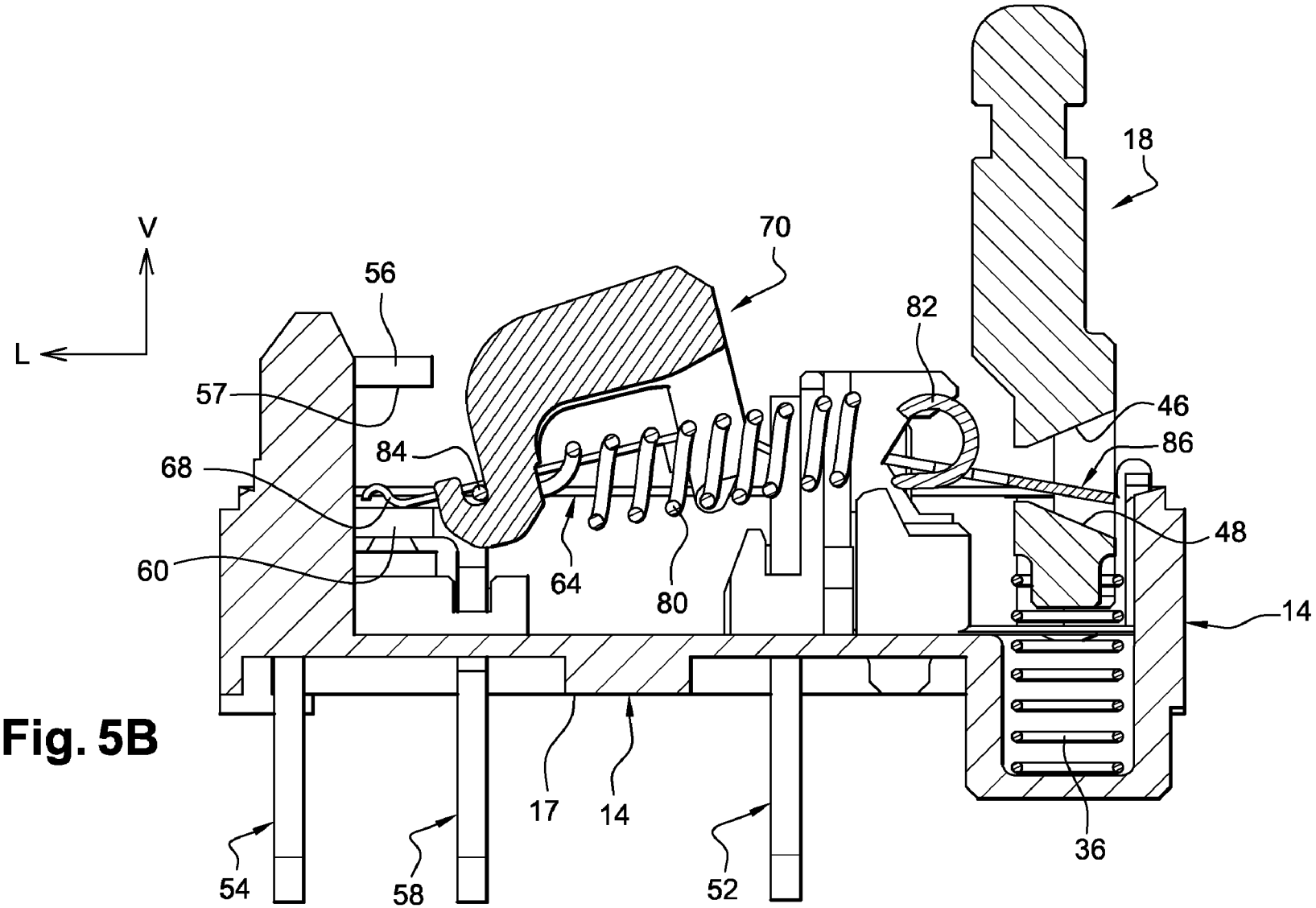
FIG. 5B is a cross-sectional view taken along line 5-5 of FIG. 4 showing various components in their first position.

As illustrated in FIGS. 5A and 5B, the switch 10 may further comprise a return spring 36 disposed vertically between the lower part 14 of the housing 12 and the lower driving portion 28 of the pushbutton 18. The return spring 36 may be a vertically and helicoidally wounded spring which is received in a pit 40 of the lower part 14. The return spring may be positioned such that its upper end may act on a lower vertically extending finger 42 of the driving portion 28.

The return spring 36 may be mounted so as to be vertically compressed in such a way that, when an external force applied downwardly to the free upper end 20 of the pushbutton is removed, the pushbutton is returned back to its upper rest position by the return spring 36. This upper rest position may be defined by the position of upper edges 31 of the wings 30 with the upper bottoms 35 of the grooves 34.

Starting from this upper position (and by compressing the return spring 36), the pushbutton 18 may be pushed downwardly towards its extreme lower position as is defined by the position of lower edges of the wings 30 with the lower bottoms of the grooves 34.

The lower driving portion 28 comprises an open V-shaped slit 44. As shown in FIGS. 5A and 5B, the slit 44 may be delimited by a first upper driving inner wall 46 and a second lower opposite driving inner wall 48. The pushbutton 18 may be longitudinally positioned at one end of the housing 10 and the V-shaped slit 44 may longitudinally converge towards the other opposite end of the housing 10. Each wall 46 and 48 may plane and terminate in an inclined small plane face 47, 49, both of which may be positioned horizontal and parallel with respect to the other.

Figure 6:
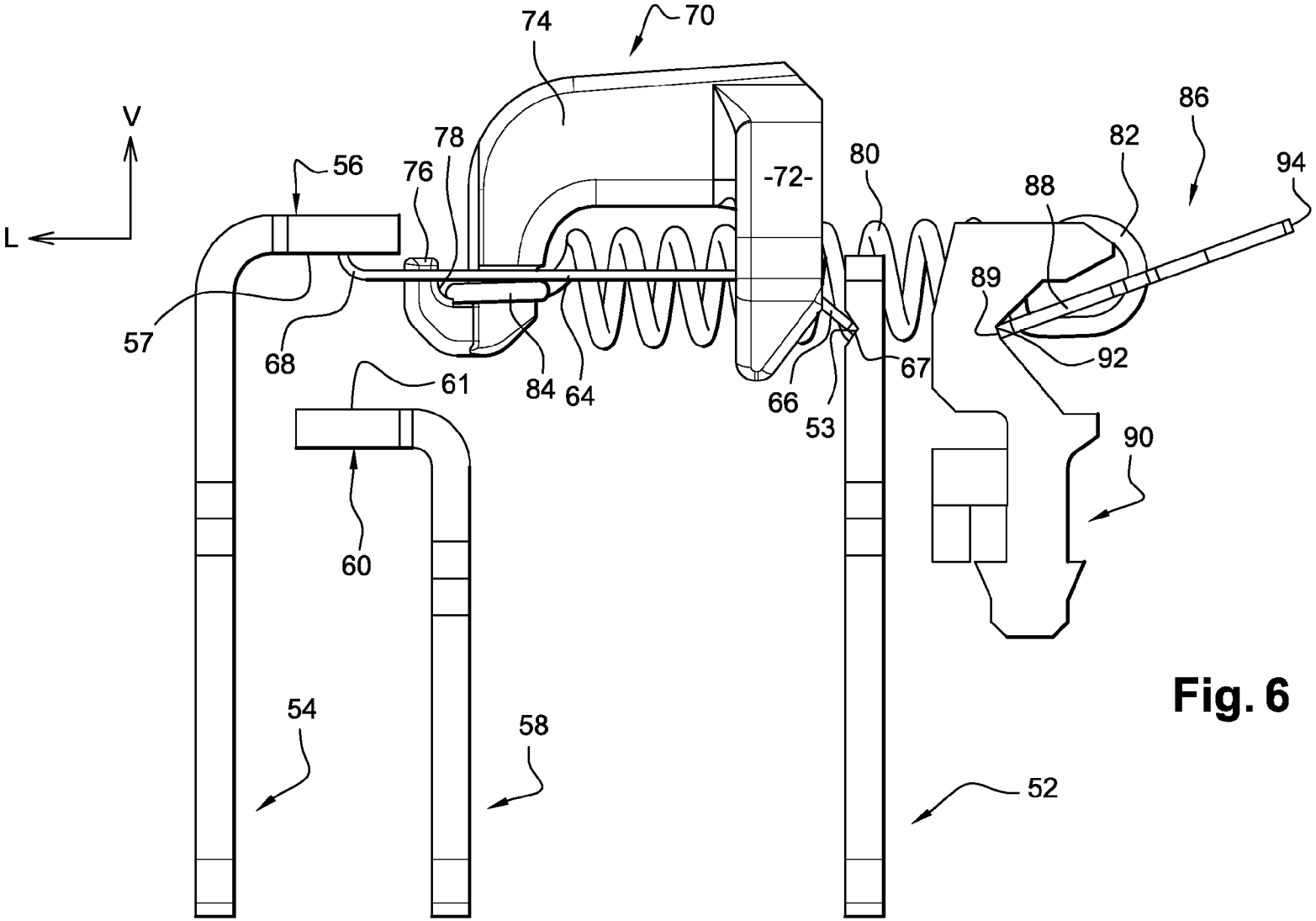
FIG. 6 is a lateral view of some of the main components of the conductive and switching units of the snap switch of FIGS. 1 and 2.

As shown in FIGS. 5A, 5B and 6, the snap switch 10 may include a conductive unit made of several conductive fixed contacts belonging to metallic fixed conductive pins made of a cut metal sheet. The conductive unit may include a pair of first conductive fixed contacts 52. The two first contacts 52 may be a pair of vertical conductive pins, each one comprising a fixed contact zone 53 in the form of a V-shaped groove. The two first contacts 52 may align transversely in a vertical plane which is substantially a middle plane arranged longitudinally between the pushbutton switch 18 and the other associated fixed contacts.

The conductive unit may also include a pair of second conductive fixed upper contacts 54. The two second contacts 54 may be a pair of vertical conductive pins, each pin having an upper horizontally bent portion 56 and a lower face thereof constituting a fixed contact zone 57. The two second contacts 54 may align transversely in a vertical plane which is arranged longitudinally substantially at the longitudinal end of the housing 10 opposed to the pushbutton switch 18.

The conductive unit may further include a pair of third conductive fixed lower contacts 58. The two third contacts may be a pair of vertical conductive pins, each pin having an upper horizontally bent portion 60 and an upper face thereof constituting a fixed contact zone 61. The two third contacts 58 may align transversely in a vertical plane which is arranged longitudinally substantially at the longitudinal end of the housing 10 opposed to the pushbutton switch 18.

All four bent portions 56 and 60 may align in the same transversal plane such that they form two pairs of fixed facing contact zones 57, 61 defining a vertical space there between. An imaginary horizontal plane passing through the centre of the grooves 53 may pass substantially in the middle of the vertical space between the pairs of fixed facing contact zones 57, 61 as shown in FIGS. 5A and 5B.

Figure 7:
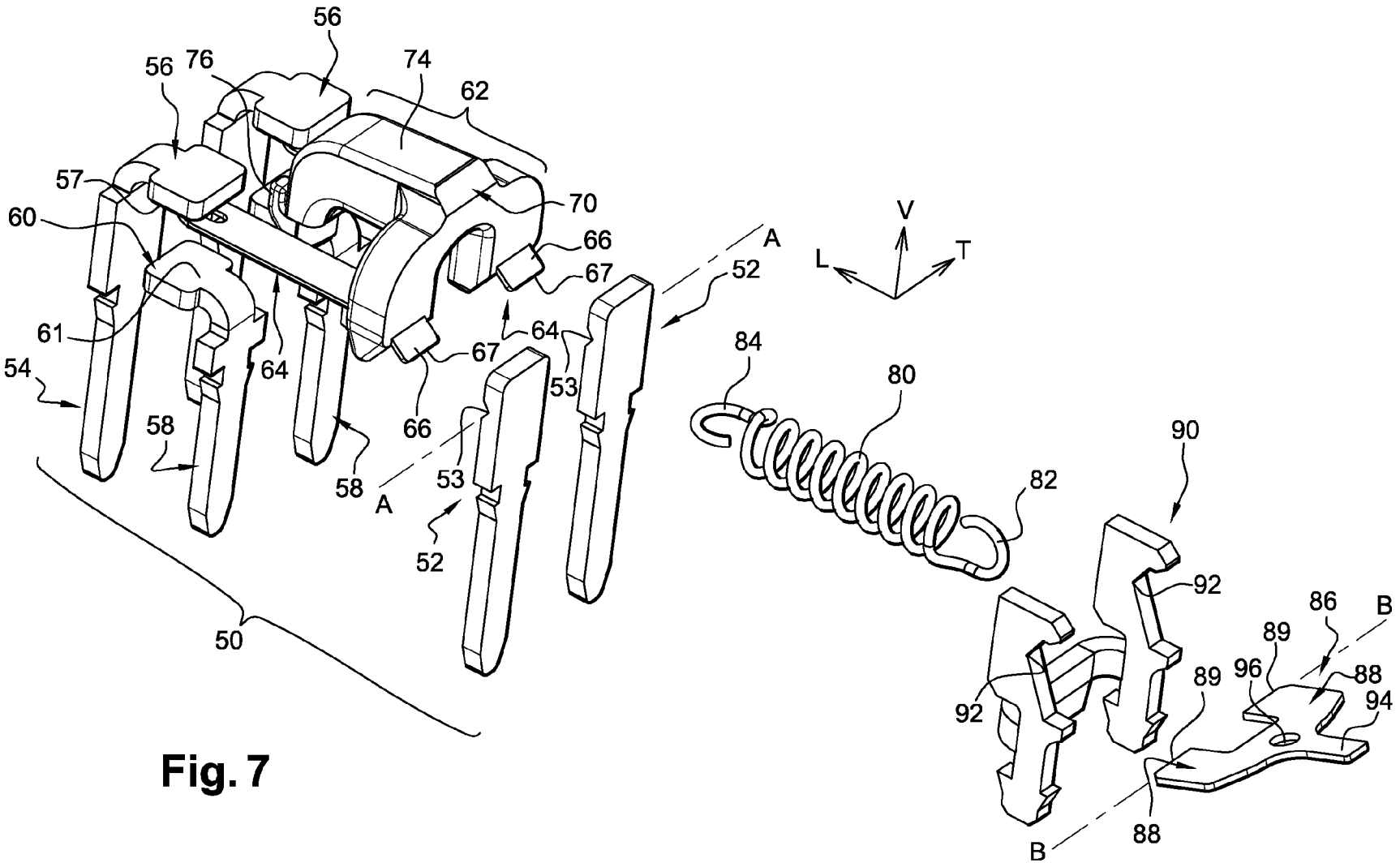
FIG. 7 is a top perspective view of various components of FIG. 6, some being illustrated in a partially exploded position.

As illustrated in FIG. 7, the snap switch 10 may further includes a switching unit 62. The switching unit 62 may be made of a pair of twin mobile contact conductive blades 64 manufactured from a cut metal sheet. Each blade 64 may constitute a swaying element and may be configured to move between the second 54 and third 58 fixed contacts. Similarly, each mobile contact blade 64 may extend longitudinally between the first fixed contacts 52 at one end, and the other fixed contacts 54 and 58 at the other end.

As shown in FIG. 7, each mobile contact blade 64 may have a first end 66 slightly bent downwardly with respect to the general plane of the blade, and a transverse edge 67 thereof may be pivotally received in a corresponding groove of an associated first fixed contact. Each mobile contact blade 64 may also have a second end 68 in formed, for example, as a fork which is positioned between the facing opposite conductive zones 57 and 61 such that the contact blade may selectively electrically connect the first conductive fixed contacts 52 to either the second 54 or the third 58 conductive fixed contacts, depending on the position of the mobile contact blade 64.

Figure 3:
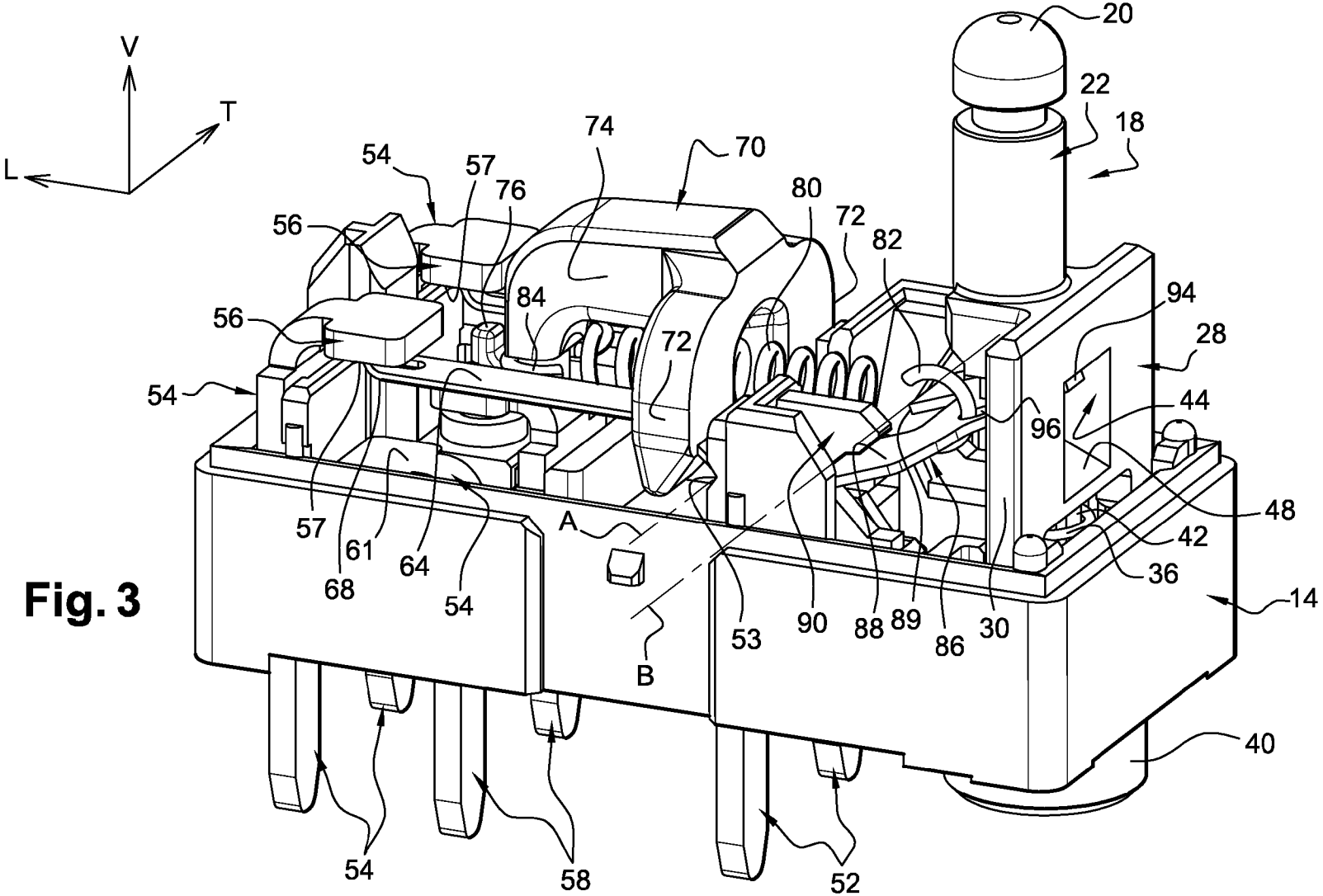
FIG. 3 is an enlarged view of the lower part of FIG. 2.

As shown in FIGS. 1, 2 and 3, each of the conductive pins 52, 54, 58 may be inserted (e.g., by forced fitting) and positioned in the lower portion 14 of the housing. Similarly, each of the conductive pins 52, 54, 58 may extend outwardly through corresponding holes vertically beyond the lower face 17 in order to constitute connecting pins of the switch 10 for connection of the latter on a printed circuit board (not shown). These terminals may be sealed with some epoxy resin depending upon the application of the switch 10.

As shown in FIGS. 5A, 5B, 6 and 7, the switch 10 may include a transmitting element 70 which may be a plastic component overmoulded on the metallic swaying contact blades 64. The transmitting element 70 may function as a single and common spring force transmitting element.

In one example, the transmitting element 70 may be formed as a reversed U-shaped stirrup wherein each lower end 72 of a lateral transverse branch is overmoulded on a corresponding facing portion of the associated blade 64 which is positioned close to its first end 66. The stirrup 70 may also include a central and substantially horizontal branch 74 which extends longitudinally towards the second free ends 68 of the blades 64. The free end 76 of the central branch 74 may terminate in a hook 78.

As shown in FIG. 7, as a result of the pivotal arrangement of the switching unit 62, with respect to the fixed contacts 52 and around the horizontal and transverse axis A-A, between the two upper and lower positions of the switching unit, the snap switch 10 may permit selective and simultaneous establishing of two first conductive ways, each one between a first conductive fixed contact 52 and a second conductive fixed contact 54 when the mobile switching unit 62 is in the position illustrated in FIGS. 5A and 5B, i.e. when the pushbutton is in the first upper active position. The switching unit 62 may also permit selective and simultaneous establishment of two second conductive ways, each one between a first conductive fixed contact 52 and a third conductive fixed contact 58 when the pushbutton is in the second lower active position.

The switching unit may be bistable between the first upper position and second lower positions. In this example, the switch may comprise a traction spring 80 having a first end 82 operatively connected to the driving portion 28 of the pushbutton via, for example, a tilting lever, and a second end 84 secured to the mobile contacts by means of the force transmitting element 70. The traction spring 80 may be a helicoidally wounded spring having its second end 84 hooked in a hook 78 of a branch 74 of the force transmitting element. The first end 82 of the traction spring 80 may be connected to the pushbutton 18 by means of a tilting lever 86 which is pivotally mounted with respect to the housing 12.

The tilting lever 86 may be formed as a metal plate pivotally mounted around a transverse and horizontal axis B-B parallel to the plane of the plate 86. The tilting lever 86 may generally be in the form of a T having two first parallel and lateral branches 88, each one having a transverse free edge 89. Each free edge 89 may be pivotally received in a corresponding groove of an associated fixed structural bracket element 90.

The structural bracket 90 may be a metallic cut element inserted (e.g., via forced fitting) in the lower part 16 of housing 12, but which has no conductive or electrical contact function. The tilting lever 86 may also comprise a second central longitudinally extending central branch 94 which constitutes the second end of the lever 86 which is received freely with play in the slit 44. The tilting lever 86 may also comprises a central hole 96 in which the first end 82 of the traction spring 80 is hooked, the hole 96 being positioned at a point which is positioned between the first 88-89 and second 94 ends of the tilting lever 86.

Due to the various geometrical parameters and dimensions, and under the action of the traction spring 80 and of the return spring 36, the bistable switching unit 62, the lever 86 and the pushbutton 18 may all normally be in their "upper" rest positions as illustrated in FIGS. 1 to 5B. When the users pushes downwardly on the stem 22 of the pushbutton, the driving portion 28 of the pushbutton 18 may act, by means of the upper inner wall 46, on the second end 94 to pivot the lever 86 from its upper first lever position in which the first end 82 of the spring 80 is in its first stable "upper" spring position, to its second stable "lower" lever position in which the first end 82 of the spring 80 is in its lower second position.

This change of position may provoke the switching, i.e. the simultaneous interruption of the two first conductive ways between the fixed contacts 52 and 54, and the subsequent simultaneous establishment of the two second conductive ways between the fixed contacts 52 and 58. It may also provoke the compression of the return spring 36. When the users releases any actuation effort on the stem 22, the previously compressed return spring 36 may act upwardly on the pushbutton 18 to push it vertically and upwardly. The driving portion 28 of the pushbutton 18 may similarly act, by means of the lower inner wall 48 of the slit 44, on the second end 94 to pivot the lever from its the second stable "lower" lever position in which the first end 82 of the spring 80 is in its lower second position, to its upper first lever position in which the first end 82 of the spring 80 is in its first stable "upper" spring position.

The described embodiment herein comprises a "double" or "twin" arrangement of two switches. However, the invention also applies to a "single" or "unique" switch for selectively establishing a first conductive way between a first conductive fixed contact and a second conductive fixed contact or a second conductive way between the first conductive fixed contact and a third conductive fixed contact. This switch is primarily used in the automotive industry for actuation of an electronic parking brake. However, this switch may be also used in many applications including automotive air-bag systems as a system shut off switch. This switch may also be used in any electronics application which, for instance, requires a double pole double throw circuit particularly if fast switching of both poles is desired.

What is claimed is:

1. A switch for selectively establishing a first conductive way between a first conductive fixed contact and a second conductive fixed contact or a second conductive way between the first conductive fixed contact and a third conductive fixed contact, the switch comprising:

a housing;

a pushbutton extending out of the housing and comprising a driving portion formed by an extension extending into the housing, the pushbutton being arranged, when an external force is applied to the pushbutton, to be moved relative to the housing between:

a first pushbutton active position in which the first conductive way is established, and a second pushbutton active position in which the second conductive way is established;

a conductive unit which is fixed with respect to the housing and which includes the first, second, and third conductive fixed contacts; and a switching unit comprising:

a conductive swaying element, wherein a first end of the conductive swaying element is pivotally engaged with the first conductive fixed contact, and a second end of the conductive swaying element is arranged to selectively electrically connect the first conductive fixed contact to either the second or the third conductive fixed contact, and a traction spring having a first end operatively connected to a driving point of the pushbutton and a second end secured to the swaying element;

a tilting lever comprising a first end pivotally engaged with the housing and a second end delimited by a first driving inner wall and a second opposite driving wall, wherein when the pushbutton is in the first pushbutton active position, the first end of the traction spring is in a first spring position and the traction spring causes the swaying element to electrically connect the first and second conductive fixed contacts, and when the pushbutton is moved to the second active pushbutton position, the first end of the traction spring is moved to a second spring position and the traction spring causes the swaying element to move to electrically connect the first and third conductive fixed contacts, and in which:

the switching unit is bistable between the first and second positions of the swaying element, the switch comprises a return spring which is disposed between the housing and the pushbutton, and when an external force applied to the pushbutton is removed, the pushbutton is returned back to its original first active position by the return spring.

2. The switch of claim 1, further comprising the tilting lever pivotally mounted with respect to the housing, wherein the first end of the traction spring is secured to the tilting lever such that the driving portion of the pushbutton acts to pivot the tilting lever between a first lever position in which the first end of the traction spring is in its first spring position and a second lever position in which the first end of the traction spring is in its second spring position such that a first end of the tilting lever is pivotally engaged with a fixed portion of the housing and a second end of the tilting lever is received in a slit of the driving portion of the pushbutton, wherein the tilting lever is delimited by a first driving inner wall which interacts with the second end of the tilting lever to provoke the pivoting of the titling lever from the first lever position to the second lever position, and a second opposite driving inner wall which interacts with a second end of the tilting level to provoke the pivoting of the tilting lever from the second lever position to the first lever position.

3. The switch of claim 2 wherein the traction spring is a helicoidally wounded spring having its first end hooked on the tilting lever.

4. The switch of claim 2 wherein each swaying element is a metallic blade such that the switch comprises a spring force transmitting element overmoulded on the metallic blade, and in that the second end of the traction spring is secured to the force transmitting element.

5. A switch for selectively establishing simultaneously two first conductive ways, each one between a first conductive fixed contact and a second conductive fixed contact or simultaneously two second conductive ways, each one between the first conductive fixed contact and a third conductive fixed contact, the switch comprising:

a housing;

a pushbutton extending out of the housing and comprising a driving portion formed by an extension extending into the housing, the pushbutton being arranged, when an external force is applied to the pushbutton, to be moved relative to the housing between:

a first pushbutton active position in which the first conductive ways are established, and a second pushbutton active position in which the second conductive ways are established;

a conductive unit which is fixed with respect to the housing and which includes the first, second, and third conductive fixed contacts;

a switching unit comprising:

a pair of conductive swaying elements, a first end of each conductive swaying element being pivotally engaged with a first associated conductive fixed contact, and the second end of each conductive swaying element being positioned to selectively electrically connect the first associated conductive fixed contact to either a second associated conductive fixed contact or a third associated conductive fixed contact, and a traction spring having a first end operatively connected to the driving portion of the pushbutton and a second end secured to the swaying elements, wherein when the pushbutton is in the first pushbutton position, the first end of the traction spring is in a first spring position and the traction spring causes the swaying elements to electrically connect the first and second associated conductive fixed contacts, and when the pushbutton is moved to the second pushbutton position, the first end of the traction spring is moved to a second spring position and the traction spring causes the swaying elements to also move to electrically connect the first and third associated conductive fixed contacts, and in which:

the switching unit is bistable between the first and second positions of the swaying element, the switch comprises a return spring which is disposed between the housing and the pushbutton, and when an external force applied to the pushbutton is removed, the pushbutton is returned back to its original first active position by the return spring.

6. The switch of claim 5, further comprising a tilting lever pivotally mounted with respect to the housing, wherein the first end of the traction spring is secured to the tilting lever such that the driving portion of the pushbutton acts to pivot the tilting lever between a first lever position in which the first end of the traction spring is in the first spring position and a second lever position in which the first end of the traction spring is in its second spring position such that a first end of the tilting lever is pivotally engaged with a fixed portion of the housing and a second end of the tilting lever is received in a slit of the driving portion of the pushbutton, wherein the tilting lever is delimited by a first driving inner wall which interacts with the second end of the tilting lever to provoke the pivoting of the tilting lever from the first lever position to the second lever position and a second opposite driving inner wall which interacts with the second end of the tilting lever to provoke the pivoting of the tilting lever from the second lever position to the first lever position.

7. The switch of claim 6 wherein the tilting lever is a plate pivotally mounted around an axis parallel to the plane of the plate.

8. The switch of claim 6 wherein the first and second inner walls are planar and form a V shaped slit.

9. The switch of claim 6 wherein the first end of the traction spring is secured to the tilting lever at a point positioned between the first and second ends of the tilting lever.

10. The switch of claim 6 wherein the traction spring is a helicoidally wounded spring having its first end hooked on the tilting lever.

11. The switch of claim 6 wherein each swaying element is a metallic blade such that the switch comprises a spring force transmitting element overmoulded on the metallic blade, and in that the second end of the traction spring is secured to the force transmitting element.

12. The switch of claim 11 wherein a single force transmitting element is overmoulded on the metallic blade.

13. The switch of claim 12 wherein the second end of the traction spring is hooked on the single force transmitting element.

14. The switch of claim 6 wherein the switch is symmetrical with respect to a median plane comprising an actuation axis of the pushbutton and a longitudinal axis of the traction spring, the two swaying elements being arranged symmetrically with respect to the plane of symmetry.

* * * * *